US008951027B2

(12) United States Patent
Petersen et al.

(10) Patent No.: US 8,951,027 B2
(45) Date of Patent: Feb. 10, 2015

(54) VANE CELL MACHINE

(71) Applicants: Hans Christian Petersen, Nordborg (DK); Ove Thorboel Hansen, Nordborg (DK); Lars Martensen, Soenderborg (DK); Palle Olsen, Nordborg (DK); Erik Haugaard, Graasten (DK)

(72) Inventors: Hans Christian Petersen, Nordborg (DK); Ove Thorboel Hansen, Nordborg (DK); Lars Martensen, Soenderborg (DK); Palle Olsen, Nordborg (DK); Erik Haugaard, Graasten (DK)

(73) Assignee: Danfoss A/S, Nordborg (DK)

( * ) Notice: Subject to any disclaimer, the term of this patent is extended or adjusted under 35 U.S.C. 154(b) by 168 days.

(21) Appl. No.: 13/659,032

(22) Filed: Oct. 24, 2012

(65) Prior Publication Data

US 2013/0108499 A1 May 2, 2013

(30) Foreign Application Priority Data

Oct. 25, 2011 (DE) ..... 10 2011 116 869

(51) Int. Cl.

| | |
|---|---|
| ***F01C 19/00*** | (2006.01) |
| ***F01C 21/00*** | (2006.01) |
| ***F04C 15/00*** | (2006.01) |
| ***F04C 2/344*** | (2006.01) |
| ***F01C 21/10*** | (2006.01) |
| *F01C 21/08* | (2006.01) |

(52) U.S. Cl.

CPC ..... *F04C 15/0023* (2013.01); *F04C 2/344* (2013.01); *F01C 21/108* (2013.01); *F01C 21/0809* (2013.01); *F04C 2230/91* (2013.01)

USPC ..... 418/144; 418/152; 418/235; 418/259

(58) Field of Classification Search

USPC ..... 418/144, 152, 235, 259–260

See application file for complete search history.

(56) References Cited

U.S. PATENT DOCUMENTS

| | | | | |
|---|---|---|---|---|
| 2,672,282 | A * | 3/1954 | Novas | 418/99 |
| 3,582,241 | A | 6/1971 | Niemiec | |
| 4,088,426 | A * | 5/1978 | Edwards | 418/8 |
| 5,947,712 | A * | 9/1999 | Viegas et al. | 418/152 |
| 6,053,718 | A | 4/2000 | Schmidt et al. | |
| 6,629,829 | B1 * | 10/2003 | Shinoda et al. | 418/102 |
| 2012/0222352 | A1 | 9/2012 | Janssen | |
| 2013/0108498 | A1 | 5/2013 | Petersen et al. | |

FOREIGN PATENT DOCUMENTS

| | | | |
|---|---|---|---|
| DE | 24 22 783 | A1 | 11/1975 |
| DE | 2422783 | A1 | 11/1975 |
| DE | 197 10 804 | A1 | 9/1998 |
| DE | 19710804 | A1 | 9/1998 |
| DE | 102010008062 | B3 | 6/2011 |
| EP | 0 247 001 | A2 | 11/1987 |
| EP | 0247001 | A2 | 11/1987 |
| EP | 0866224 | A1 | 9/1998 |
| EP | 2357362 | A2 | 8/2011 |
| WO | 8700587 | A1 | 1/1987 |

* cited by examiner

*Primary Examiner* — Hoang Nguyen

(74) *Attorney, Agent, or Firm* — McCormick, Paulding & Huber LLP

(57) ABSTRACT

The invention concerns a vane cell machine having a stator and a rotor that is made of a first material, the rotor having guides comprising radially displaceable vanes that rest on an inside of the stator and border work chambers at each axial end of the rotor together with the rotor, the stator and individual stationary side walls, the vanes having, at least at some contact faces with the rotor and the stator, a second material that interacts unfrictionally with the first material. It is endeavoured to keep the wear small. For this purpose, in a radially inner area, the side wall comprises a surface of a third material interacting unfrictionally with the first material and, in a radially outer area a surface made of the first material.

21 Claims, 3 Drawing Sheets

VANE CELL MACHINE

CROSS REFERENCE TO RELATED APPLICATION

Applicants hereby claim foreign priority benefits under U.S.C. §119 from German Patent Application No. 10 2011 116 869.2 filed on Oct. 25, 2011, the contents of which are incorporated by reference herein.

TECHNICAL FIELD

The invention concerns a vane cell machine having a stator and a rotor that is made of a first material, the rotor having guides comprising radially displaceable vanes that rest on an inside of the stator and border work chambers at each axial end of the rotor together with the rotor, the stator and individual stationary side walls, the vanes having, at least at some contact faces with the rotor and the stator, a second material that interacts unfrictionally with the first material.

BACKGROUND

Such a vane cell machine is, for example, used as amplification pump behind a pressure converter in a circuit of a reverse osmosis system. In a reverse osmosis system water, for example saltwater, is pumped through a membrane, so that purified water is available at its outlet side.

With this application, a certain difficulty lies in the fact that water cannot be used for lubrication of the mutually moving parts to the same extent as other fluids, particularly oil or oil-containing fluids.

It is therefore known in connection with mutually moving surfaces to use a material pair that interacts unfrictionally also or particularly during operation with water as fluid. When using steel as metal for one element of the material pair, the material for the second element can be selected from the group of high-resistant thermo-plastic plastic materials on the basis of polyaryletherketones, in particular polyetheretherketones, polyamides, polyacetals, polyarylethers, polyethyleneterephtalates, polyphenylensulfides, polysulphones, polyethersulphones, polyetherimides, polyamidimides, polyacrylates, phenol-resins, such as novolacquer-resins, and glass, graphite, polytetraflourethylene or carbon, particularly as fibers, can be used as filler. When using such materials, the vane cell machine can also be operated with water.

However, in spite of the use of such material pairs, it has turned out that internal leakages appear which can be blamed on wear.

SUMMARY

The invention is based on the task of keeping the wear in a vane cell machine small even with a good internal tightness.

With a vane cell machine as mentioned in the introduction, this task is solved in that, in a radially inner area, the side wall comprises a surface of a third material interacting unfrictionally with the first material and, in a radially outer area a surface made of the first material.

With this embodiment, the side wall is thus divided into two surface areas that differ with respect to their surface properties. On the radial inside, the surface is, for example, made of one of the plastic materials mentioned above, in particular polyether etherketones (PEEK), that interacts unfrictionally with, for example, the metal or steel of the rotor. Thus, in this area the friction between the front side of the rotor and the side wall can be kept relatively small, as the plastic material and the metal interact unfrictionally. In a radial outer area, however, the side wall is made of the first material, for example metal. In this area there is a friction between the vanes and the side wall. However, here the vanes are provided with a surface of the third material, for example the friction-reducing plastic material, so that also here an unfrictionally interacting material pair occurs. On the one hand, the front sides of the vanes move in the circumferential direction in relation to the side wall and on the other hand they also move in the radial direction, as during one rotation of the rotor in relation to the stator they are extended and retracted at least once. The radially inner area and the radially outer area can now be made so that the vanes practically only move along the surface made of the first material, for example metal, and the rotor is only moved along the surface made of the third material, for example plastic material. Also when, during their movement, the vanes will from time to time have a slight overlapping with the third material, meaning that here the second and the third material will rub on each other, this embodiment is much less subjected to wear. Therefore, such a vane cell machine can be used as a hydraulic machine and in particular as a water hydraulic machine.

Preferably, the side wall is made as a plate. A plate is easily worked so that the two different surface areas can be formed. The plate will then be assembled with the stator as a separate element.

Alternatively, the side wall can be formed in a housing of the vane cell machine. In this case, no additional element is required, which will also have a positive effect on the accuracy during assembly. The smaller the number of parts to assemble, the lower the risk of errors caused by tolerances.

Preferably, in the radially inner area, the side wall comprises an insert with a surface made of the third material. With such an insert it is easy to realise the radially inner area, whose surface is made of the third material. The insert can be manufactured and worked separately from the plate or the housing. Accordingly, it can be manufactured with a relatively high accuracy. This simplifies the manufacturing. If required, the insert can also have a core of steel, another metal or another material. However, it can also be formed completely of the third material. The insert can be connected to the plate. However, it is also possible that the insert is slightly movable in relation to the plate in parallel to the axis of the rotor.

Preferably, the insert is arranged in a central recess in the side wall and comprises an eccentric bore through which the rotor is led. In a vane cell machine with one work stroke of the vanes per rotation of the rotor, the inside of the stator, on which the vanes bear, can be made with a hollow cylindrical shape. In order still to realise the radial extension and retraction movements of the vanes, the rotor is eccentrically born, that is, during each rotation one point on the circumference of the rotor approaches the inside of the stator and moves away from the inside of the stator again. This eccentricity is easily realised by means of the insert. This embodiment has the further advantage that it can be ensured in a simple manner that the vanes with their front sides can always bear on the area that is made of the first material. The vanes must always bear on the inside of the stator, meaning that, in the case of a stator with a hollow cylindrical shape they move along an annularly shaped path that can be bordered on the radial inside by the central recess in the side wall. When the stator has a differently shaped inner wall, other movement paths of the vanes are possible.

Preferably, a sealing ring is arranged on the side of the insert facing away from the rotor. This sealing ring, for example an O-ring, which is arranged in a groove in the insert, seals the insert towards the outside. This is advantageous, as the contact faces between the insert and the plate forming the side wall or the corresponding part of the housing cannot be made absolutely tight at a reasonable effort. Thus, the sealing ring prevents large amounts of fluid from leaving the stator towards the outside at this position.

Preferably, the sealing ring is arranged at a radial position of the rotor that corresponds to the radial inside of the guides. In this case, it is possible to generate a hydraulic balance on the insert in the axial direction. A hydraulic pressure from the guide acts in the axial direction from the inside towards the outside. A hydraulic pressure from an area radially outside of the sealing ring acts in the axial direction from the outside towards the inside. By providing the sealing ring, the surfaces, upon which the pressures corresponding to each other act, can be kept approximately equally large, so that here no forces occur, which could favour wear.

Preferably, the insert comprises an axial extension that forms a bearing for a shaft that is connected to the rotor. Thus, it is possible to make the insert so that at the same time it forms the bearing for the shaft of the rotor. As at least the surface of the insert is made of the third material, preferably a friction-reducing plastic material, it can also interact with the shaft that is usually also made of a metal, for example steel.

In this case, it is advantageous that the extension comprises a step that forms a bearing surface for the sealing ring. In this case, the sealing ring can be arranged at the same radial position, namely so that its position corresponds to the radial inside of the guides.

Preferably, at least one side wall comprises an opening arrangement with at least one opening, the opening being bordered radially outside by a surface section, on which the vanes bear. The opening can be made as an inlet opening or an outlet opening. When the opening arrangement comprises several openings, one group of these openings is expediently formed as inlet opening and another group of these openings is expediently formed as outlet opening. When the opening arrangement of each side wall comprises only one opening (or one group of uniform openings), an inlet opening will be provided on one front side and an outlet opening will be provided on the opposite front side. As the vanes are supported axially by the surface section also in the area of the opening, the vanes can be prevented from tilting in the area of the opening. Such tilting has a negative effect on the inner tightness of the vane cell machine.

In a preferred embodiment it may be ensured that the vanes are also supported by a surface section at the radial inside of the openings, so that also when passing the opening they are safely supported and guided at both of their radial ends. This keeps the wear small.

BRIEF DESCRIPTION OF THE DRAWINGS

In the following, the invention is described on the basis of preferred embodiments in connection with the drawings, showing.

DETAILED DESCRIPTION

Figure 2:
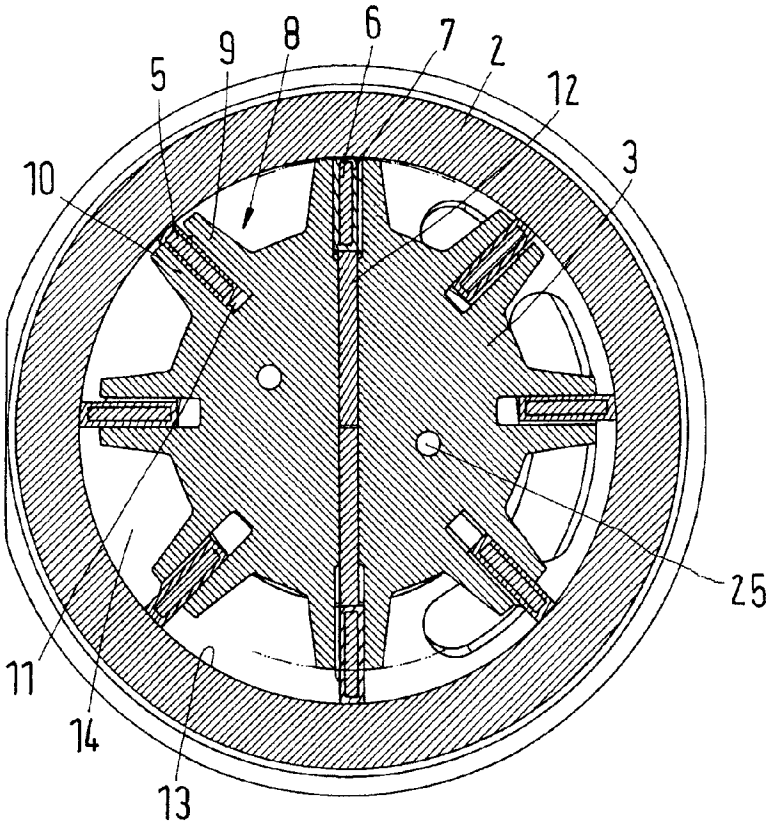
FIG. 2 is a section II-II according to FIG. 1.
Figure 1:
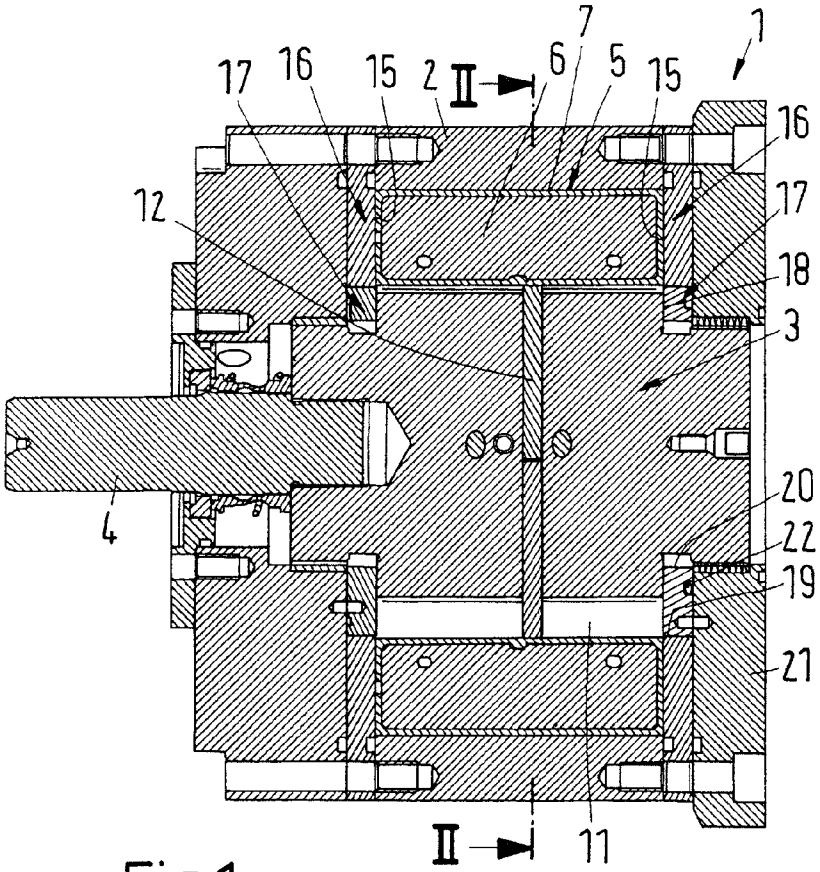
FIG. 1 is a schematic longitudinal section through a vane cell machine.

A vane cell machine 1 comprises a stator 2, in which a rotor 3 is rotatably supported. The rotor is connected to a shaft 4 that is connected to a drive motor (not shown in detail) when the vane cell machine 1 is made as a pump. When the vane cell machine 1 works as a motor, an output can be taken at the shaft 4.

The rotor 3 is made of a first material, preferably steel. In the circumferential direction, several vanes 5 are arranged in the rotor 3, each vane having a core 6 of steel that is surrounded by an enclosure 7 that is made of a second material that differs from the first material, preferably a plastic material that interacts unfrictionally with the steel of the rotor 3. The stator 2 is also made of the first material, preferably steel. The enclosure 7 also interacts unfrictionally with the material of the stator 2, also when the vane cell machine is operated with water.

In the following description the first material is steel and the second material is a plastic material that interacts unfrictionally with steel.

As plastic material for the enclosure 7, the following materials from the group of high-resistant thermo-plastic plastic materials on the basis of polyaryletherketones, in particular polyetheretherketones, polyamides, polyacetals, polyarylethers, polyethyleneterephtalates, polyphenylensulfides, polysulphones, polyethersulphones, polyetherimides, polyamidimides, polyacrylates, phenol-resins, such as novolacquer-resins, and glass, graphite, polytetraflourethylene or carbon, particularly as fibers, can be used as filler.

For each vane, the rotor 3 comprises a guide 8. Each guide 8 comprises two substantially radially progressing and axially extending walls 9, 10, between which the vane 5 is guided in the radial direction (in relation to the rotation axis of the rotor). On the radial inside of the vane 5, the guide comprises a chamber 11, into which fluid can get through a gap between the vane 5 and the walls 9, 10.

As can be seen from FIG. 2, the rotor 3 comprises an even number of vanes 5. A rod 12 is positioned between any two diametrically opposed vanes 5. This rod 12 is also made of the friction-reducing plastic material. The rod 12 is dimensioned so that each of the diametrically opposed vanes 5 bears on the inside 13 of the stator 2. A small tolerance is permitted in order to avoid jamming.

Any two neighbouring vanes 5 in the circumferential direction border a chamber 14. As can be seen from FIG. 2, the volume of the chamber 14 changes during a rotation of the rotor inside the stator 2, as known from vane cell machines.

The chambers 14 must be sealed at their axial front sides. For this purpose, a side wall 15 is formed at each front side of the vane 5. In the present case, the side wall 15 is formed on a plate 16. The plate 16 is made of steel, so that the vane 5 with its enclosure 7 can rub on the plate 16. Due to the plastic material of the enclosure 7, a movement with a relatively small friction occurs here.

An insert 17 is inserted in the plate 16. The insert is, at least at its surface, made of a third material that can be equal to the second material. Thus, here the surface of the insert 17 is also made of the friction-reducing plastic material. The insert 17 rests on a front side section 18 of the rotor 3.

The insert 17 is inserted in a central bore 19 of the plate 16. The insert 17 comprises an eccentric bore 20 through which the rotor 3 is led. Accordingly, it is possible to dimension the plate 16 and the insert 17 so that during the complete rotation the vanes 5 with their enclosures 7 only rest on the plate 16, that is, on steel, whereas the rotor 3 with its front side section 18 only rests on the insert 17, that is, on plastic material. Merely in the area of the radial inner end of the vane 5 a slight overlapping between the vane 5 and the insert 17 can occur, which is, however, uncritical, as it is so small.

With this embodiment it can be ensured that friction only occurs between parts, of which one has a surface of steel and one has a surface of the friction-reducing plastic material, for example PEEK.

It is possible for fluid under pressure to penetrate axially to the outside between the plate 16 and the insert 17. Accordingly, an O-ring 22 (or a corresponding sealing) is arranged between the insert 17 and a front side housing part 21. The O-ring 22 can be mounted with an axial and/or radial preloading, so that it can also be used for tightening at small pressures, for example in order to avoid a leakage during start-up. In the radial direction the O-ring 22 has a position that corresponds to the radial inner end of the chamber 11. Thus, the pressure in the chamber 11 acts upon the same surface of the insert 17 as the pressure between the O-ring 22, or rather between the radial outer border of the sealing generated by the O-ring 22, and the radial inner end of the individual vane 5. Thus, a hydraulic balance is generated over the insert 17. This has a positive effect on the operational behaviour of the vane cell machine 1. In particular, excessive wear at the contact point between the rotor 3 and the insert 17 can be avoided.

The rotor 3 comprises several axially extending through channels 25, which ensure a pressure balancing between the axial rotor ends. The insert 17 can be movable in the axial direction in relation to the plate 16, that is, the insert 17 forms some sort of "piston". Due to the hydraulic balance it can be ensured that this "piston" always bears on the rotor 3 with the "appropriate" force, that is, with sufficient sealing, but without excessive friction. The division into insert 17 and plate 16 also simplifies the manufacturing. The plate 16 and the insert 17 can be made with plane parallel surfaces. The insert 17 can be slightly thicker than the plate 16.

In an embodiment that is not shown in detail, the plate 16 can also be made in one unit with the front-side housing part 21. In this case, one part is abolished, namely the plate 16. This requires some additional working of the front-side housing part 21. However, inaccuracies are smaller, which could occur because of tolerances on the individual components.

Figure 3:
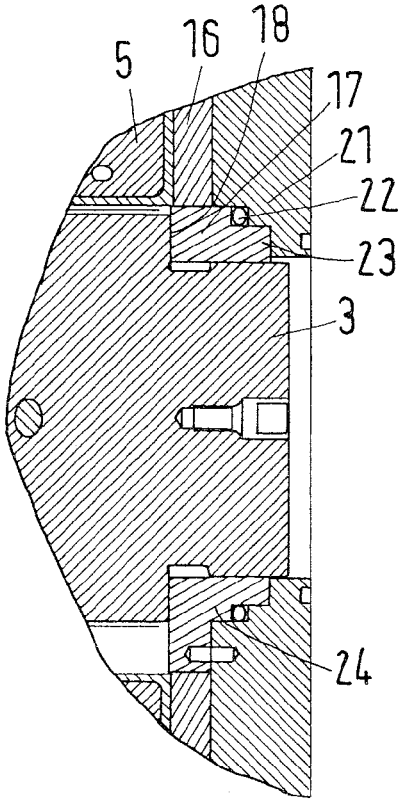
FIG. 3 is a partial section through a modified embodiment of a vane cell machine.
Figure 4C:
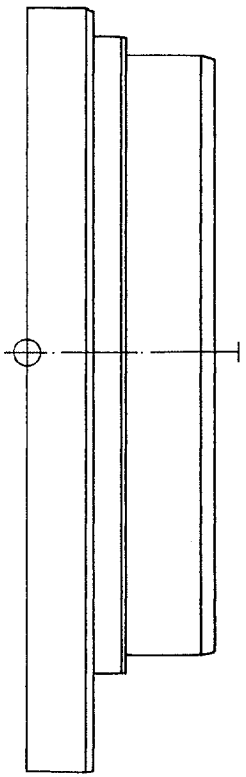
FIGS. 4*a*, 4*b*, and 4*c* are enlarged views of an insert according to FIG. 3.
Figure 4B:
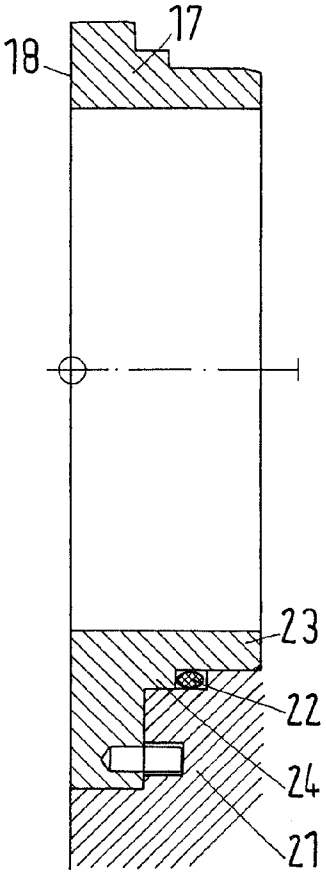
Figure 4A:
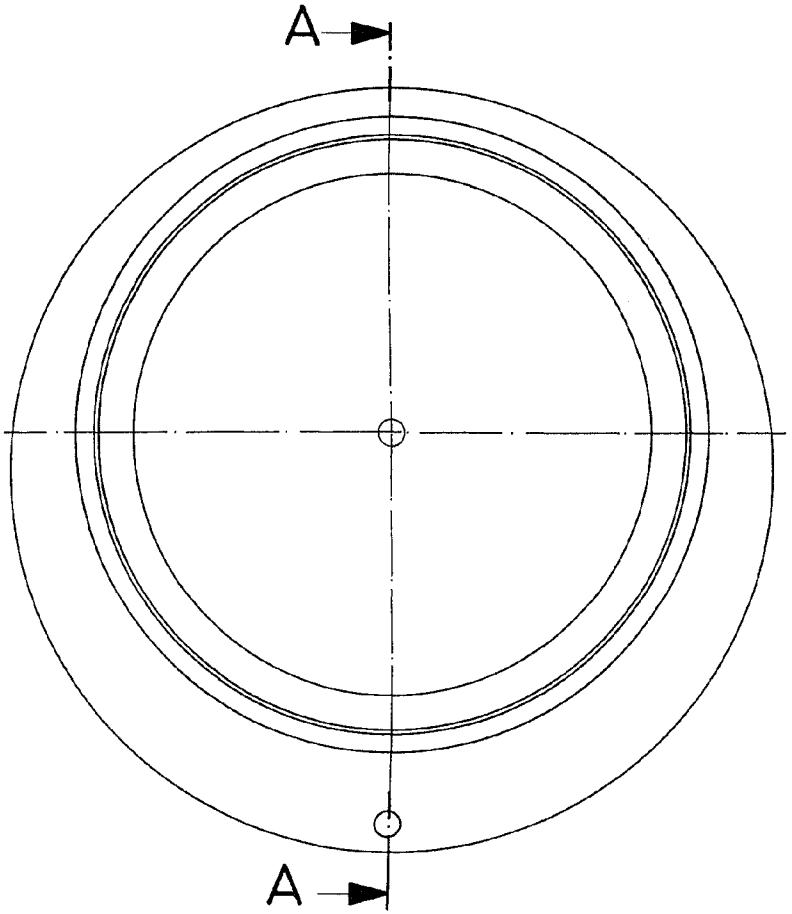

FIG. 3 shows a slightly modified embodiment, in which the same elements have the same reference numbers. FIG. 4 shows the insert 17 alone, namely in FIG. 4*a* a front view, FIG. 4*b* a section A-A according to FIG. 4*a* and FIG. 4*c* a side view.

The insert 17 is now extended in the axial direction and forms a bearing 23 for the rotor 3. Accordingly, also the material pair between the rotor 3 (steel) and the bearing 23 on its circumferential surface (PEEK) is made so that here an unfrictional behavior occurs. The O-ring 22 is arranged at the same radial position, that is, it is located where the chamber 11 ends radially inwards.

In order to realise this position of the O-ring 22 in a simple manner, the insert 17 is provided with a step 24, on which the O-ring can bear with its front side. At the same time it can also be slightly compressed in the radial direction.

While the present invention has been illustrated and described with respect to a particular embodiment thereof, it should be appreciated by those of ordinary skill in the art that various modifications to this invention may be made without departing from the spirit and scope of the present.

What is claimed is:

1. A vane cell machine having a stator and a rotor that is made of a first material, the rotor having guides comprising radially displaceable vanes that rest on an inside of the stator and border work chambers at each axial end of the rotor together with the rotor, the stator and individual side walls, at least at some contact faces with the rotor and the stator, the vanes having a second material that interacts unfrictionally with the first material, wherein in a radially inner area, the side wall comprises a surface of a third material interacting unfrictionally with the rotor and, in a radially outer area a surface made of the first material.

2. The vane cell machine according to claim 1, wherein the side wall is made as a plate.

3. The vane cell machine according to claim 1, wherein the side wall is formed in a housing of the vane cell machine.

4. The vane cell machine according to claim 2, wherein a radially inner area, the side wall comprises an insert made of the third material.

5. The vane cell machine according to claim 4, wherein the insert is arranged in a central recess in the side wall and comprises an eccentric bore through which the rotor is led.

6. The vane cell machine according to claim 4, wherein a sealing ring is arranged on the side of the insert facing away from the rotor.

7. The vane cell machine according to claim 4, wherein the sealing ring is arranged at a radial position of the rotor that corresponds to the radial inside of the guides.

8. The vane cell machine according to claim 4, wherein the insert comprises an axial extension that forms a bearing for a shaft that is connected to the rotor.

9. The vane cell machine according to claim 8, wherein the extension comprises a step that forms a bearing surface for the sealing ring.

10. The vane cell machine according to claim 1, wherein at least one front wall comprises an opening arrangement with at least one opening, the opening being bordered radially outside by a surface section, on which the vanes bear.

11. The vane cell machine according to claim 1, wherein the second material and the third material are the same.

12. The vane cell machine according to claim 1, wherein the first material is steel and the second material and the third material are plastic materials interacting unfrictionally with steel.

13. The vane cell machine according to claim 3, wherein a radially inner area, the side wall comprises an insert made of the third material.

14. The vane cell machine according to claim 5, wherein the sealing ring is arranged at a radial position of the rotor that corresponds to the radial inside of the guides.

15. The vane cell machine according to claim 5, wherein the insert comprises an axial extension that forms a bearing for a shaft that is connected to the rotor.

16. The vane cell machine according to claim 6, wherein the insert comprises an axial extension that forms a bearing for a shaft that is connected to the rotor.

17. The vane cell machine according to claim 7, wherein the insert comprises an axial extension that forms a bearing for a shaft that is connected to the rotor.

18. The vane cell machine according to claim 2, wherein at least one front wall comprises an opening arrangement with at least one opening, the opening being bordered radially outside by a surface section, on which the vanes bear.

19. The vane cell machine according to claim 3, wherein at least one front wall comprises an opening arrangement with at least one opening, the opening being bordered radially outside by a surface section, on which the vanes bear.

20. The vane cell machine according to claim 4, wherein at least one front wall comprises an opening arrangement with at least one opening, the opening being bordered radially outside by a surface section, on which the vanes bear.

21. A vane cell machine comprising:

a stator and a rotor made of a first material; and a plurality of guides formed in the rotor and comprising radially displaceable vanes that rest on an inside of the stator, the vanes together with the rotor, the stator and individual side walls define work chambers, the vanes having contact faces with the rotor and the stator, at least some contact faces being made of a second material that interacts unfrictionally with the first material, wherein in a radially inner area, the side wall comprises a surface of a third material interacting unfrictionally with the rotor and, in a radially outer area, the side wall having a surface made of the first material.

* * * * *